US010660364B2

(12) United States Patent
Ajithkumar et al.

(10) Patent No.: US 10,660,364 B2
(45) Date of Patent: May 26, 2020

(54) HEATED AEROSOL-GENERATING ARTICLES COMPRISING IMPROVED RODS

(71) Applicant: Philip Morris Products S.A., Neuchatel (CH)

(72) Inventors: Anu Ajithkumar, Neuchatel (CH); Irene Chetschik, Zurich (CH); Jean-Pierre Schaller, Geneva (CH)

(73) Assignee: Philip Morris Products S.A., Neuchatel (CH)

( * ) Notice: Subject to any disclaimer, the term of this patent is extended or adjusted under 35 U.S.C. 154(b) by 202 days.

(21) Appl. No.: 14/917,215

(22) PCT Filed: Oct. 13, 2014

(86) PCT No.: PCT/EP2014/071859
§ 371 (c)(1),
(2) Date: Mar. 7, 2016

(87) PCT Pub. No.: WO2015/055567
PCT Pub. Date: Apr. 23, 2015

(65) Prior Publication Data

US 2016/0213063 A1 Jul. 28, 2016

(30) Foreign Application Priority Data

Oct. 14, 2013 (EP) ..... 13188598

(51) Int. Cl.
*A24F 47/00* (2020.01)
*A24D 1/02* (2006.01)
(Continued)

(52) U.S. Cl.
CPC ..... *A24F 47/006* (2013.01); *A24B 3/14* (2013.01); *A24B 3/18* (2013.01); *A24B 15/14* (2013.01);
(Continued)

(58) Field of Classification Search
CPC ..... A24F 47/006; A24B 3/14
(Continued)

(56) References Cited

U.S. PATENT DOCUMENTS 2,976,873 A * 3/1961 Carmellini ..... A24B 15/14 131/372
3,628,541 A * 12/1971 Buchmann ..... A24B 3/14 131/355
(Continued)

FOREIGN PATENT DOCUMENTS

CH 691 156 A5 5/2001
CN 851 05001 A 1/1987
(Continued)

OTHER PUBLICATIONS

Combined Chinese Office Action and Search Report dated Jul. 5, 2017 in Chinese Patent Application No. 201480051994.8 (with English translation).
(Continued)

*Primary Examiner* — Eric Yaary
*Assistant Examiner* — Russell E Sparks
(74) *Attorney, Agent, or Firm* — Oblon, McClelland, Maier & Neustadt, L.L.P.

(57) ABSTRACT

A heated aerosol-generating article is provided, including an aerosol-generating substrate including a rod, the rod including a gathered sheet of homogenised tobacco material circumscribed by a wrapper. The gathered sheet of homogenised tobacco material includes one or more plasticisers and at least about 5 percent by weight triethyl citrate on a dry weight basis. The one or more plasticisers may be selected from the group consisting of propylene glycol, sugars, and polyhydric alcohols. The sheet of homogenised tobacco material may be crimped or otherwise textured.

7 Claims, 1 Drawing Sheet

(51) Int. Cl.

| | |
|---|---|
| ***A24F 42/10*** | (2020.01) |
| ***A24B 3/14*** | (2006.01) |
| ***A24B 3/18*** | (2006.01) |
| ***A24B 15/14*** | (2006.01) |
| ***A24B 15/16*** | (2020.01) |
| ***A24B 15/32*** | (2006.01) |

(52) U.S. Cl.
CPC ..... *A24B 15/165* (2013.01); *A24B 15/32* (2013.01); *A24D 1/02* (2013.01); *A24F 42/10* (2020.01)

(58) Field of Classification Search
USPC ..... 131/329
See application file for complete search history.

(56) References Cited

U.S. PATENT DOCUMENTS

| | | | | |
|---|---|---|---|---|
| 3,860,012 | A | 1/1975 | Selke | |
| 3,894,544 | A | 7/1975 | Egri | |
| 3,908,671 | A * | 9/1975 | Cogbill, II | A24D 1/02 131/334 |
| 4,000,748 | A | 1/1977 | Summers | |
| 4,281,671 | A | 8/1981 | Bynre et al. | |
| 5,027,837 | A | 7/1991 | Clearman et al. | |
| 5,247,947 | A * | 9/1993 | Clearman | A24F 47/004 131/194 |
| 5,724,998 | A | 3/1998 | Gellatly et al. | |
| 6,095,152 | A * | 8/2000 | Beven | A24B 15/165 131/194 |
| 7,074,170 | B2 | 7/2006 | Lanier, Jr. et al. | |
| 2006/0130862 | A1 | 6/2006 | Dittrich et al. | |
| 2008/0295853 | A1 | 12/2008 | Jones | |
| 2011/0259352 | A1 | 10/2011 | Woodcock et al. | |
| 2012/0006343 | A1* | 1/2012 | Renaud | A24B 15/12 131/280 |
| 2012/0152264 | A1 | 6/2012 | Coleman et al. | |
| 2012/0160253 | A1 | 6/2012 | Coleman et al. | |
| 2014/0326260 | A1 | 11/2014 | Gladden et al. | |

FOREIGN PATENT DOCUMENTS

| | | | | |
|---|---|---|---|---|
| CN | 85 1 06273 | A | 2/1987 | |
| CN | 1078621 | A | 11/1993 | |
| CN | 101015392 | A | 8/2007 | |
| CN | 102186366 | A | 9/2011 | |
| CN | 103263072 | A | 8/2013 | |
| EP | 0 822 760 | A2 | 2/1998 | |
| GB | 983928 | A | 2/1965 | |
| JP | 10-507629 | | 7/1998 | |
| JP | 2001-501452 | | 2/2001 | |
| JP | 2013-519384 | | 5/2013 | |
| TW | 201143640 | A1 | 12/2011 | |
| TW | 201302107 | A1 | 1/2013 | |
| WO | WO 96/07336 | A2 | 3/1996 | |
| WO | WO 2009/022232 | A2 | 2/2009 | |
| WO | 2010/043475 | A1 | 4/2010 | |
| WO | WO 2011/101164 | A1 | 8/2011 | |
| WO | WO-2012014490 | A1 * | 2/2012 | A24F 47/006 |
| WO | WO 2012/110819 | A1 | 8/2012 | |
| WO | 2012/164077 | A1 | 12/2012 | |
| WO | WO 2012/164009 | A2 | 12/2012 | |

OTHER PUBLICATIONS

International Search Report and Written Opinion dated Jan. 28, 2015 for PCT/EP2014/071859 filed on Oct. 13, 2014.
European Office Action dated Apr. 19, 2018 in European Patent Application No. 14783644.9, 5 pages.
Combined Chinese Office Action and Search Report dated Mar. 12, 2018 in Patent Application No. 201480051994.8 (with English language translation), 19 pages.
Office Action dated Aug. 6, 2018 in Japanese Patent Application No. 2016-547236 with English translation, 8 pages.
European Office Action dated Oct. 14, 2019, in Patent Application No. 14 783 644.9, 5 pages.

* cited by examiner

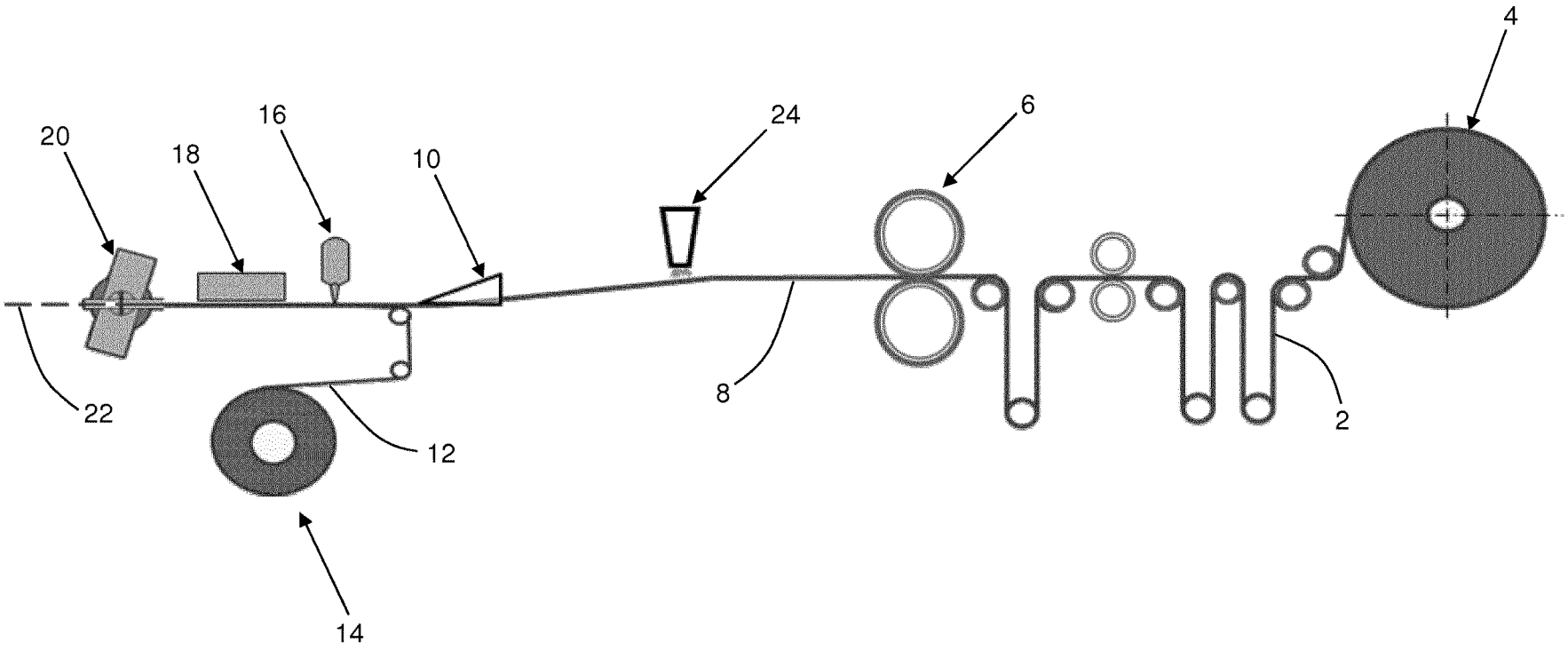
4
2
6
24
8
10
12
14
16
18
20
22

HEATED AEROSOL-GENERATING ARTICLES COMPRISING IMPROVED RODS

The present invention relates to heated aerosol-generating articles comprising aerosol-generating substrates, wherein the aerosol-generating substrates comprise improved rods comprising a gathered sheet of homogenised tobacco material.

Processes and apparatus for producing shreds, strands or strips of tobacco material for use in the formation of rods for smoking articles are known in the art. Typically, the width of such shreds, strands and strips of tobacco material is about 3 mm or less.

For example, U.S. Pat. No. 4,000,748 discloses a process and apparatus for shredding a sheet of reconstituted tobacco into strips and crimping the resultant strips in a substantially simultaneous operation. The crimped strips are reported to provide an increase in fill value.

The formation of rods for smoking articles comprising crimped or uncrimped shreds of tobacco material suffers from a number of disadvantages including those discussed below.

Firstly, shredding tobacco material undesirably generates tobacco fines and other waste.

Secondly, rods comprising shreds of tobacco material exhibit 'loose ends'. That is a loss of shreds of tobacco material from the ends of the rod. This is exacerbated by breakage of the shreds of tobacco material during rod formation. Loose ends are not only aesthetically undesirable, but can also disadvantageously lead to the need for more frequent cleaning of manufacturing equipment and smoking devices.

Thirdly, rods comprising shreds of tobacco material exhibit high weight standard deviations. That is rods of the same dimensions tend to be of inconsistent weight. This is due in part to the tendency of the rods to exhibit loose ends as mentioned above. The high weight standard deviation of rods comprising shreds of tobacco material leads to an undesirably high rejection rate of rods whose weight falls outside of a selected acceptance range.

Fourthly, rods comprising shreds of tobacco material exhibit non-uniform densities. That is the density along the length of the rod tends to be inconsistent. This is due to variations in the quantity of tobacco material at different locations along the rod, which results in 'voids', that is reduced quantities of tobacco material, and 'pads', that is increased levels of tobacco material. The non-uniform density of rods comprising shreds of tobacco material can undesirably affect the resistance to draw (RTD) of the rods. In addition, the non-uniform density of rods comprising shreds of tobacco material can lead to loose ends when a void is located at the end of the rod.

A number of aerosol-generating articles in which tobacco material is heated rather than combusted have been proposed in the art. Typically in heated aerosol-generating articles, an aerosol is generated by the transfer of heat from a heat source, for example a chemical, electrical or combustible heat source, to a physically separate aerosol-generating substrate, which may be located within, around or downstream of the heat source. Rods of tobacco material for use as aerosol-generating substrates in heated aerosol-generating articles are typically significantly shorter in length than combustible rods of tobacco material for use in conventional lit end smoking articles. Rods of short length are sometimes referred to as plugs.

Loose ends, high weight standard deviations and non-uniform densities as exhibited by rods comprising shreds of tobacco material are particularly problematic and undesirable in rods of short length. For example, the problem of loose ends is exacerbated in aerosol-generating articles because, as rods of tobacco material for use as aerosol-generating substrates in heated aerosol-generating articles are typically significantly shorter in length than rods of combustible tobacco material for use in conventional lit end smoking articles, the proportion of tobacco material that is in proximity to an end of the rod is greater.

To overcome the disadvantages discussed above, WO-A2-2012/164009 discloses rods for use as aerosol-generating substrates in heated aerosol-generating articles comprising a gathered sheet of homogenised tobacco material comprising one or more aerosol-formers circumscribed by a wrapper, wherein the sheet of homogenised tobacco material has an aerosol former content of greater than 5 percent on a dry weight basis or between 5 percent and 30 percent by weight on a dry weight basis. WO-A2-2012/164009 discloses that suitable aerosol-formers for inclusion in the gathered sheet of homogenised tobacco material include polyhydric alcohols, such as triethylene glycol, 1,3-butanediol and glycerine.

It would be desirable to provide improved rods comprising a gathered sheet of homogenised tobacco material for use in heated aerosol-generating articles. In particular, it would be desirable to provide rods comprising a gathered sheet of homogenised tobacco material for use for use as aerosol-generating substrates in heated aerosol-generating articles that generate aerosols with enhanced sensorial perception when heated.

According to the invention there is provided a heated aerosol-generating article comprising an aerosol-generating substrate, wherein the aerosol-generating substrate comprises a rod comprising a gathered sheet of homogenised tobacco material circumscribed by a wrapper, wherein the sheet of homogenised tobacco material comprises one or more plasticisers and at least about 5 percent by weight triethyl citrate on a dry weight basis. According to a particularly preferred aspect, there is provided a heated aerosol-generating article comprising a combustible heat source and an aerosol-generating substrate, wherein the aerosol-generating substrate comprises a rod comprising a gathered sheet of homogenised tobacco material circumscribed by a wrapper, wherein the sheet of homogenised tobacco material comprises one or more plasticisers and at least about 5 percent by weight triethyl citrate on a dry weight basis.

According to the invention there is also provided use of a rod comprising a gathered sheet of homogenised tobacco material circumscribed by a wrapper, wherein the sheet of homogenised tobacco material comprises one or more plasticisers and at least about 5 percent by weight triethyl citrate on a dry weight basis, as an aerosol-generating substrate in a heated aerosol-generating article. According to a particularly preferred aspect, there is provided use of a rod comprising a gathered sheet of homogenised tobacco material circumscribed by a wrapper, wherein the sheet of homogenised tobacco material comprises one or more plasticisers and at least about 5 percent by weight triethyl citrate on a dry weight basis, as an aerosol-generating substrate in a heated aerosol-generating article comprising a combustible heat source.

As used herein, the term 'rod' is used to describe a generally cylindrical element of substantially circular, oval or elliptical cross-section.

As used herein, the term 'homogenised tobacco material' denotes a material formed by agglomerating particulate tobacco.

As used herein, the term 'gathered' is used to describe a sheet of homogenised tobacco material that is convoluted, folded, or otherwise compressed or constricted substantially transversely to the cylindrical axis of the rod.

As used herein, the term 'sheet' is used to describe a laminar element having a width and length substantially greater than the thickness thereof.

As used herein, the term 'length' is used to describe the dimension in the direction of the cylindrical axis of the rod.

As used herein, the term 'width' is used to describe a dimension in a direction substantially perpendicular to the cylindrical axis of the rod.

As used herein, the term 'aerosol-generating substrate' is used to describe a substrate capable of releasing upon heating volatile compounds, which can form an aerosol. The aerosols generated from aerosol-generating substrates in heated aerosol-generating articles according to the invention may be visible or invisible and may include vapours (for example, fine particles of substances, which are in a gaseous state, that are ordinarily liquid or solid at room temperature) as well as gases and liquid droplets of condensed vapours. In heated aerosol-generating articles according to the invention, the entire rod including the wrapper is considered to be the aerosol-generating substrate.

It will be appreciated that in the following description of the invention, features described in relation to one embodiment of the invention may also be applicable to other embodiments of the invention.

In the following description of the invention, the expression 'rods for use in the invention' refers to rods comprising a gathered sheet of homogenised tobacco material circumscribed by a wrapper, wherein the sheet of homogenised tobacco material comprises one or more plasticisers and at least about 5 percent by weight triethyl citrate on a dry weight basis.

It has surprisingly been found that inclusion of a combination of one or more plasticisers and at least about 5 percent by weight triethyl citrate on a dry weight basis in the sheet of homogenised tobacco material advantageously improves the sensory properties of aerosols generated by rods for use in the invention when heated. In particular, it has been found that rods for use in the invention advantageously generate aerosols having an aroma, taste and mouth feeling more reminiscent of mainstream tobacco smoke of conventional lit-end cigarettes when heated.

A number of flavor compounds present in the mainstream tobacco smoke of conventional lit-end cigarettes are non-polar. Triethyl citrate is of reduced polarity compared to other aerosol-formers such as glycerine. Without wishing to be bound by theory, it is believed that inclusion of a combination of one or more plasticisers and at least about 5 percent by weight triethyl citrate on a dry weight basis as an aerosol former in the sheet of homogenised tobacco material reduces the polarity of aerosols generated by rods for use in the invention when heated.

Preferably, the sheet of homogenised tobacco material comprises less than or equal to about 25 percent by weight triethyl citrate on a dry weight basis. More preferably, the sheet of homogenised tobacco material comprises less than or equal to about 20 percent by weight triethyl citrate on a dry weight basis.

Preferably, the sheet of homogenised tobacco material comprises at least about 5 percent by weight plasticiser on a dry weight basis.

Preferably, the sheet of homogenised tobacco material comprises less than or equal to about 25 percent by weight plasticiser on a dry weight basis. More preferably, the sheet of homogenised tobacco material comprises less than or equal to about 20 percent by weight plasticiser on a dry weight basis.

Preferably, the total amount of plasticiser and triethyl citrate in the sheet of homogenised tobacco material is at least about 10 percent by weight on a dry weight basis.

Preferably, the total amount of plasticiser and triethyl citrate in the sheet of homogenised tobacco material is less than or equal to about 30 percent by weight on a dry weight basis. More preferably, the total amount of plasticiser and triethyl citrate in the sheet of homogenised tobacco material is less than or equal to about 25 percent by weight on a dry weight basis.

Preferably, the ratio of the percent by weight on a dry weight basis of plasticiser to triethyl citrate in the sheet of homogenised tobacco material is between about 1:1 and about 2:1. More preferably, the ratio of the percent by weight on a dry weight basis of plasticiser to triethyl citrate in the sheet of homogenised tobacco material is between about 1:1 and about 1.7:1.

It has further been found that inclusion of a combination of one or more plasticisers and at least about 5 percent by weight triethyl citrate on a dry weight basis in the sheet of homogenised tobacco material advantageously results in the sheet being sufficiently flexible and strong to be gathered to form a rod for use in the invention.

Preferably, the sheet of homogenised tobacco material has a fracture force per unit width in the cross direction of at least about 160 N/m as measured for a test specimen with a length of 50 mm using a constant extension rate of 50 mm/min using a tensile test machine, such as for example, an INSTRON 5565 tensile test machine or equivalent with a 100 N load cell.

As used herein, the term 'fracture force per unit width' is used to describe the force at fracture for a 1 metre wide sheet.

Preferably, the sheet of homogenised tobacco material comprises one or more plasticisers selected from the group consisting of propylene glycol, sugars and polyhydric alcohols.

Suitable sugars for inclusion as plasticisers in the sheet of homogenised tobacco material include, but are not limited to, fructose, glucose, invert sugar and combinations thereof.

Suitable polyhydric alcohols for inclusion as plasticisers in the sheet of homogenised tobacco material include, but are not limited to, glycerine, sugar alcohols, such as erythritol and sorbitol, and combinations thereof.

The gathered sheet of homogenised tobacco material preferably extends along substantially the entire length of the rod and across substantially the entire transverse cross-sectional area of the rod.

The inclusion of a gathered sheet of homogenised tobacco material in rods for use in the invention advantageously significantly reduces the risk of loose ends compared to rods comprising shreds of tobacco material.

Rods comprising a gathered sheet of homogenised tobacco material for use in the invention advantageously exhibit significantly lower weight standard deviations than rods comprising shreds of tobacco material. The weight of a rod for use in the invention of a particular length is determined by the density, width and thickness of the sheet of homogenised tobacco material that is gathered to form the rod. The weight of rods for use in the invention of a particular length can thus be regulated by controlling the density and dimensions of the sheet of homogenised tobacco material. This reduces inconsistencies in weight between rods for use in the invention of the same dimensions, and so results in lower rejection rate of rods whose weight falls outside of a selected acceptance range.

Rods comprising a gathered sheet of homogenised tobacco material for use in the invention advantageously exhibit more uniform densities than rods comprising shreds of tobacco material.

In preferred embodiments, rods for use in the invention comprise a gathered textured sheet of homogenised tobacco material circumscribed by a wrapper.

Use of a textured sheet of homogenised tobacco material may advantageously facilitate gathering of the sheet of homogenised tobacco material to form a rod for use in the invention.

As used herein, the term 'textured sheet' is used to describe a sheet that has been crimped, embossed, debossed, perforated or otherwise deformed. Textured sheets of homogenised tobacco material for use in the invention may comprise a plurality of spaced-apart indentations, protrusions, perforations or a combination thereof.

In particularly preferred embodiments, rods for use in the invention comprise a gathered crimped sheet of homogenised tobacco material circumscribed by a wrapper.

As used herein, the term 'crimped sheet' is intended to be synonymous with the term 'creped sheet' and denotes a sheet having a plurality of substantially parallel ridges or corrugations. Preferably, the crimped sheet of homogenised tobacco material has a plurality of ridges or corrugations substantially parallel to the cylindrical axis of the rod. This advantageously facilitates gathering of the crimped sheet of homogenised tobacco material to form the rod. However, it will be appreciated that crimped sheets of homogenised tobacco material for use in the invention may alternatively or in addition have a plurality of substantially parallel ridges or corrugations disposed at an acute or obtuse angle to the cylindrical axis of the rod.

In certain embodiments, sheets of homogenised tobacco material for use in the invention may be substantially evenly textured over substantially their entire surface. For example, crimped sheets of homogenised tobacco material for use in the invention may comprise a plurality of substantially parallel ridges or corrugations that are substantially evenly spaced-apart across the width of the sheet.

Rods comprising a gathered sheet of homogenised tobacco material circumscribed by a wrapper, wherein the sheet of homogenised tobacco material comprises one or more plasticisers and at least about 5 percent by weight triethyl citrate on a dry weight basis, are especially suited for use as aerosol-generating substrates in heated aerosol-generating articles.

Rods comprising a gathered sheet of homogenised tobacco material circumscribed by a wrapper, wherein the sheet of homogenised tobacco material comprises one or more plasticisers and at least about 5 percent by weight triethyl citrate on a dry weight basis, may be used as aerosol-generating substrates in heated aerosol-generating articles and heated aerosol-generating systems according to the invention comprising a suitable heat source, including but not limited to, a chemical heat source, an electrical heat source, a combustible heat source or a heat sink.

Rods comprising a gathered sheet of homogenised tobacco material circumscribed by a wrapper, wherein the sheet of homogenised tobacco material comprises one or more plasticisers and at least about 5 percent by weight triethyl citrate on a dry weight basis, may be used as aerosol-generating substrates in heated aerosol-generating articles according to the invention comprising a combustible heat source and an aerosol-generating substrate. According to a preferred aspect, rods comprising a gathered sheet of homogenised tobacco material circumscribed by a wrapper, wherein the sheet of homogenised tobacco material comprises one or more plasticisers and at least about 5 percent by weight triethyl citrate on a dry weight basis, may be used as aerosol-generating substrates in heated aerosol-generating articles according to the invention comprising a combustible heat source and an aerosol-generating substrate downstream of the combustible heat source. According to a particularly preferred aspect, rods comprising a gathered sheet of homogenised tobacco material circumscribed by a wrapper, wherein the sheet of homogenised tobacco material comprises one or more plasticisers and at least about 5 percent by weight triethyl citrate on a dry weight basis, may be used as aerosol-generating substrates in heated aerosol-generating articles according to the invention comprising a combustible carbonaceous heat source and an aerosol-generating substrate downstream of the combustible carbonaceous heat source.

As used herein, the term 'carbonaceous' is used to describe a combustible heat source comprising carbon.

For example, rods comprising a gathered sheet of homogenised tobacco material circumscribed by a wrapper, wherein the sheet of homogenised tobacco material comprises one or more plasticisers and at least about 5 percent by weight triethyl citrate on a dry weight basis, may be used as aerosol-generating substrates in heated aerosol-generating articles according to the invention of the type disclosed in WO-A2-2009/022232, which comprise a combustible carbonaceous heat source, an aerosol-generating substrate downstream of the combustible carbonaceous heat source, and a heat-conducting element around and in contact with a rear portion of the combustible carbonaceous heat source and an adjacent front portion of the aerosol-generating substrate.

However, it will be appreciated that rods comprising a gathered sheet of homogenised tobacco material circumscribed by a wrapper, wherein the sheet of homogenised tobacco material comprises one or more plasticisers and at least about 5 percent by weight triethyl citrate on a dry weight basis, may also be used as aerosol-generating substrates in heated aerosol-generating articles according to the invention comprising combustible heat sources having other constructions.

As used herein, the terms 'distal', 'upstream', 'proximal' and 'downstream' are used to describe the relative positions of components, or portions of components, of heated aerosol-generating articles according to the invention in relation to the direction in which a user draws on the heated aerosol-generating article during use thereof.

Heated aerosol-generating articles according to the invention comprise a proximal end through which, in use, an aerosol exits the heated aerosol-generating article for delivery to a user. The proximal end may also be referred to as the mouth end. In use, a user draws on the proximal end of the heated aerosol-generating article in order to inhale an aerosol generated by the heated aerosol-generating article. The heated aerosol-generating article comprises a distal end opposed to the proximal end.

The proximal end may also be referred to as the downstream end of the heated aerosol-generating article and the distal end may also be referred to as the upstream end of the heated aerosol-generating article. Components, or portions of components, of heated aerosol-generating articles according to the invention may be described as being upstream or downstream of one another based on their relative positions between the proximal end and the distal end of the heated aerosol-generating article.

Rods comprising a gathered sheet of homogenised tobacco material circumscribed by a wrapper, wherein the sheet of homogenised tobacco material comprises one or more plasticisers and at least about 5 percent by weight triethyl citrate on a dry weight basis, may also be used as aerosol-generating substrates in heated aerosol-generating articles according to the invention for use in heated aerosol-generating systems comprising a heated aerosol-generating article and an aerosol-generating device in cooperation with the heated aerosol-generating article, the aerosol-generating device comprising heating means configured to heat the aerosol-generating substrate of the heated aerosol-generating article.

As used herein, the term 'aerosol-generating device' is used to describe a device that interacts with an aerosol-generating substrate of a heated aerosol-generating article to generate an aerosol that is directly inhalable into a user's lungs thorough the user's mouth.

According to a preferred aspect, rods comprising a gathered sheet of homogenised tobacco material circumscribed by a wrapper, wherein the sheet of homogenised tobacco material comprises one or more plasticisers and at least about 5 percent by weight triethyl citrate on a dry weight basis, may be used as aerosol-generating substrates in heated aerosol-generating articles according to the invention for use in electrically heated aerosol-generating systems comprising an aerosol-generating article and an aerosol-generating device in cooperation with the aerosol-generating article, the aerosol generating device comprising electrical heating means configured to heat the aerosol-generating substrate of the heated aerosol-generating article.

For example, rods comprising a gathered sheet of homogenised tobacco material circumscribed by a wrapper, wherein the sheet of homogenised tobacco material comprises one or more plasticisers and at least about 5 percent by weight triethyl citrate on a dry weight basis, may be used as aerosol-generating substrates in heated aerosol-generating articles according to the invention of the type disclosed in EP-A2-0 822 670.

Insertion and removal from an electrically heated aerosol-generating system of heated aerosol-generating articles including an aerosol-generating substrate comprising a rod comprising shreds of tobacco material tends to dislodge shreds of tobacco material from the rod. This can disadvantageously result in the need for more frequent cleaning of the electrical heat source and other parts of the electrically heated aerosol-generating system in order to remove the dislodged shreds.

In contrast, insertion and removal from an electrically heated aerosol-generating system of heated aerosol-generating articles according to the invention including an aerosol-generating substrate comprising a rod comprising a gathered sheet of homogenised tobacco material advantageously does not result in dislodgement of tobacco material.

Preferably, rods for use in the invention are of substantially uniform cross-section.

Rods for use in the invention may be produced having different dimensions.

For example, rods for use in the invention may have a diameter of between about 5 mm and about 10 mm.

Preferably, rods for use as aerosol-generating substrates in heated aerosol-generating articles according to the invention have a length of between about 5 mm and about 30 mm, more preferably between about 5 mm and about 25 mm.

Rods for use in the invention of a desired unit length may be produced by forming a rod of multiple unit length and then cutting or otherwise dividing the rod of multiple unit length into multiple rods of the desired unit length.

For example, rods for use in the invention having a length of about 15 mm may be produced by forming a rod having a length of about 150 mm and then severing the elongate rod into ten rods having a length of about 15 mm.

Sheets of homogenised tobacco material for use in the invention may be formed by agglomerating particulate tobacco obtained by grinding or otherwise comminuting one or both of tobacco leaf lamina and tobacco leaf stems. Alternatively, or in addition, sheets of homogenised tobacco material for use in the invention tobacco may comprise one or more of tobacco dust, tobacco fines and other particulate tobacco by-products formed during, for example, the treating, handling and shipping of tobacco.

Sheets of homogenised tobacco material for use in the invention preferably comprise particulate tobacco obtained by grinding or otherwise comminuting tobacco leaf lamina.

In certain embodiments, sheets of homogenised tobacco material for use in the invention may have a tobacco content of at least about 40 percent by weight on a dry weight basis or of at least about 50 percent by weight on a dry weight basis. In other embodiments, sheets of homogenised tobacco material for use in the invention may have a tobacco content of about 70 percent or more by weight on a dry weight basis. The use of sheets of homogenised tobacco material having high tobacco contents advantageously generates aerosols with enhanced tobacco flavor.

Sheets of homogenised tobacco material for use in the invention may comprise one or more intrinsic binders that is a tobacco endogenous binder, one or more extrinsic binders that is a tobacco exogenous binder, or a combination thereof to help agglomerate the particulate tobacco. Alternatively, or in addition, sheets of homogenised tobacco material for use in the invention may comprise other additives including, but not limited to, tobacco and non-tobacco fibres, flavorants, fillers, aqueous and non-aqueous solvents and combinations thereof.

Suitable extrinsic binders for inclusion in sheets of homogenised tobacco material for use in the invention are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Suitable non-tobacco fibres for inclusion in sheets of homogenised tobacco material for use in the invention are known in the art and include, but are not limited to: cellulose fibers; soft-wood fibres; hard-wood fibres; jute fibres and combinations thereof. Prior to inclusion in sheets of homogenised tobacco material for use in the invention, non-tobacco fibres may be treated by suitable processes known in the art including, but not limited to: mechanical pulping; refining; chemical pulping; bleaching; sulfate pulping; and combinations thereof.

Sheets of homogenised tobacco material for use in the invention should have sufficiently high tensile strength to survive being gathered to form rods. In certain embodiments non-tobacco fibres may be included in sheets of homogenised tobacco material for use in the invention in order to achieve an appropriate tensile strength.

For example, homogenised sheets of tobacco material for use in the invention may comprise between about 1 percent and about 5 percent non-tobacco fibres by weight on a dry weight basis.

It will be appreciated that the composition of sheets of homogenised tobacco material for use in the invention may be designed to comply with regulatory requirements.

A number of reconstitution processes for producing sheets of homogenised tobacco materials are known in the art. These include, but are not limited to: paper-making processes of the type described in, for example, U.S. Pat. No. 3,860,012; casting or 'cast leaf' processes of the type described in, for example, U.S. Pat. No. 5,724,998; dough reconstitution processes of the type described in, for example, U.S. Pat. No. 3,894,544; and extrusion processes of the type described in, for example, in GB-A-983,928. Typically, the densities of sheets of homogenised tobacco material produced by extrusion processes and dough reconstitution processes are greater than the densities of sheets of homogenised tobacco materials produced by casting processes.

Sheets of homogenised tobacco material for use in the invention are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

Sheets of homogenised tobacco material for use in the invention may be textured using suitable known machinery for texturing filter tow, paper and other materials.

For example, sheets of homogenised tobacco material for use in the invention may be crimped using a crimping unit of the type described in CH-A5-691156, which comprises a pair of rotatable crimping rollers. However, it will be appreciated that sheets of homogenised tobacco material for use in the invention may be textured using other suitable machinery and processes that deform or perforate the sheets of homogenised tobacco material.

Rods for use in the invention may be produced from sheets of homogenised tobacco material having different dimensions depending upon their intended use.

Sheet of homogeneous tobacco material for use in the invention should be of sufficient width to be gathered to form a rod.

Preferably, sheets of homogeneous tobacco material for use in the invention have a width of at least about 25 mm.

In certain embodiments sheets of homogeneous tobacco material for use in the invention may have a width of between about 25 mm and about 300 mm.

The resistance to draw of a rod for use in the invention of a particular maximum transverse dimension is influenced by the width of the sheet of homogeneous tobacco material gathered to form the rod. The width of the sheet of homogenous tobacco material should be greater than the maximum transverse dimension of the rod.

Preferably, the width of the sheet of homogenised material is at least three times the maximum transverse dimension of the rod.

In certain embodiments, the width of the sheet of homogenised material may be at least five times the maximum transverse dimension of the rod. In other embodiments, the width of the sheet of homogenised material may be at least ten times the maximum transverse dimension of the rod.

Preferably, sheets of homogeneous tobacco material for use in the invention have a thickness of at least about 50 μm.

In certain embodiments, sheets of homogeneous tobacco material for use in the invention may have a thickness of between 50 μm and about 300 μm.

In certain embodiments, sheets of homogenised tobacco material for use in the invention may have a grammage between about 100 $g/m^2$ and about 300 $g/m^2$.

Rods for use in the invention may comprise a gathered sheet of homogenised tobacco material circumscribed by a porous wrapper or a non-porous wrapper.

In certain embodiments, rods for use in the invention may comprise a gathered sheet of homogenised tobacco material circumscribed by a paper wrapper.

Suitable paper wrappers for use in the invention are known in the art and include, but are not limited to, cigarette papers and filter plug wraps.

In other embodiments, rods for use in the invention may comprise a gathered sheet of homogenised tobacco material circumscribed by a non-paper wrapper.

Suitable non-paper wrappers for use in the invention are known in the art and include, but are not limited to: homogenised tobacco materials.

Rods for use in the invention may be produced using conventional cigarette making and cigarette filter making machinery.

For example, rods comprising a gathered crimped sheet of homogeneous tobacco material for use in the invention may be produced using machinery for forming filter rods comprising a gathered crimped sheet of paper of the type described in CH-A5-691156.

In certain embodiments, rods for use in the invention may be formed by a method comprising the steps of: providing a continuous sheet of homogenised tobacco material sheet comprising one or more plasticisers and at least about 5 percent by weight triethyl citrate on a dry weight basis; gathering the continuous sheet of homogenised tobacco material transversely relative to the longitudinal axis thereof; circumscribing the gathered continuous sheet of homogenised tobacco material with a wrapper to form a continuous rod; and severing the continuous rod into a plurality of discrete rods.

The method may further comprise texturing the continuous sheet of homogenised tobacco material. For example, the method may comprise crimping, embossing, perforating or otherwise texturing the continuous sheet of homogenised tobacco material prior to gathering the continuous sheet of homogenised tobacco material transversely relative to the longitudinal axis thereof.

Preferably, the method further comprises crimping the continuous sheet of homogenised tobacco material.

The method may further comprise applying one or more additives to the continuous sheet of homogenised tobacco material. For example, the method may comprise spraying, dusting, sprinkling or otherwise applying one or more additives to the continuous sheet of homogenised tobacco material prior to gathering the continuous sheet of homogenised tobacco material transversely relative to the longitudinal axis thereof.

The one or more additives may be: one or more liquid additives; or one or more solid additives; or a combination of one or more liquid additives and one or more solid additives.

Suitable liquid and solid additives for use in the invention are known in the art and include, but are not limited to: flavorants, such as for example menthol; adsorbents, such as for example activated carbon; and botanical additives.

The one or more additives may be applied to substantially the entire continuous sheet of homogenised tobacco material. Alternatively, the one or more additives may be applied to selected regions or portions of the continuous sheet of homogenised tobacco material.

Where the method also further comprises texturing the continuous sheet of homogenised tobacco material, the one or more additives may be applied to the continuous sheet of homogenised tobacco material prior to or after texturing the continuous sheet of homogenised tobacco material.

Preferably, the method comprises applying the one or more additives to the continuous sheet of homogenised tobacco material after texturing the continuous sheet of homogenised tobacco material.

Alternatively or in addition to applying one or more additives to the continuous sheet of homogenised tobacco material, the method may comprise incorporating a continuous element to which one or more additives have been applied into the gathered continuous sheet of homogenised tobacco material. For example, the method may comprise incorporating a continuous element impregnated with a liquid flavourant into the gathered continuous sheet of homogenised tobacco material.

Suitable continuous elements for use in the invention are known in the art and include, but are not limited to: threads; yarns; tapes; filaments and other elongate elements.

Continuous elements for use in the invention may be formed from any suitable known materials capable of carrying one or more additives including, but not limited to: cotton; cellulose acetate; rayon; tobacco; and other textile or non-textile materials. Continuous elements may be incorporated into the gathered continuous sheet of homogenised tobacco material using suitable known machinery for incorporating continuous elements into continuous rods of cellulose acetate tow and other filter materials such as described in, for example, U.S. Pat. Nos. 4,281,671 and 7,074,170.

The invention will be further described, by way of example only, with reference to the accompanying drawings in which:

FIG. 1 shows a schematic cross-section of apparatus for forming a rod for use as an aerosol-generating substrate in a heated aerosol-generating article according to the invention.

The apparatus shown in FIG. 1 generally comprises: supply means for providing a continuous sheet of homogenised tobacco material; crimping means for crimping the continuous sheet of homogenised tobacco material; rod forming means for gathering the continuous crimped sheet of homogenised tobacco material and circumscribing the gathered continuous crimped sheet of homogenised tobacco material with a wrapper to form a continuous rod; and cutting means for severing the continuous rod into a plurality of discrete rods. The apparatus also comprises transport means for transporting the continuous sheet of homogenised tobacco material downstream through the apparatus from the supply means to the rod forming means via the crimping means.

As shown in FIG. 1, the supply means comprises a continuous sheet of homogenised tobacco material 2 mounted on a bobbin 4 and the crimping means comprises a pair of rotatable crimping rollers 6. In use, the continuous sheet of homogenised tobacco material 2 is drawn from the bobbin 4 and transported downstream to the pair of crimping rollers 6 by the transport mechanism via a series of guide and tensioning rollers. As the continuous sheet of homogenised tobacco material 2 is fed between the pair of crimping rollers 6, the crimping rollers engage and crimp the continuous sheet of homogenised tobacco material 2 to form a continuous crimped sheet of homogenised tobacco material 8 having a plurality of spaced-apart ridges or corrugations substantially parallel to the longitudinal axis of the sheet of homogenised tobacco material through the apparatus.

The continuous crimped sheet of homogenised tobacco material 8 is transported downstream from the pair of crimping rollers 6 to the rod forming means by the transport mechanism where it is fed through a converging funnel or horn 10. The converging funnel 10 gathers the continuous crimped sheet of homogenised tobacco material 8 transversely relative to the longitudinal axis of the sheet of homogenised tobacco material. The continuous crimped sheet of homogenised tobacco material 8 assumes a substantially cylindrical configuration as it passes through the converging funnel 10.

Upon exiting the converging funnel 10, the gathered continuous crimped sheet of homogenised tobacco material is wrapped in a continuous sheet of wrapping material 12. The continuous sheet of wrapping material is fed from a bobbin 14 and enveloped around the gathered continuous crimped sheet of homogenised tobacco material by an endless belt conveyor or garniture. As shown in FIG. 1, the rod forming means comprises an adhesive application means 16 that applies adhesive to one of the longitudinal edges of the continuous sheet of wrapping material, so that when the opposed longitudinal edges of the continuous sheet of wrapping material are brought into contact they adhere to one other to form a continuous rod.

The rod forming means further comprises a drying means 18 downstream of the adhesive application means 16, which in use dries the adhesive applied to the seam of the continuous rod as the continuous rod is transported downstream from the rod forming means to the cutting means.

The cutting means comprises a rotary cutter 20 that severs the continuous rod into a plurality of discrete rods of unit length or multiple unit length.

The apparatus shown in FIG. 1 further comprises an additive application means 24 located between the crimping means and the rod forming means for applying solid or liquid additives such as, for example, flavorants, to the continuous crimped sheet of homogenised tobacco material 8 before it is gathered transversely relative to the longitudinal axis thereof by the converging funnel 10.

In one alternative embodiment (not shown), the additive application means is located between the supply means and the crimping means for applying solid or liquid additives to the continuous sheet of homogenised tobacco material before it is crimped.

In another alternative embodiment (not shown), the additive application means is located adjacent to the converging funnel 10 of the rod forming means and is adapted to apply solid or liquid additives to the gathered continuous crimped sheet of homogenised tobacco material before it is wrapped in the continuous sheet of wrapping material 12.

In a further embodiment (not shown) the apparatus further comprises means located between the crimping means and the rod forming means for incorporating a continuous element to which one or more additives have been applied into the continuous crimped sheet of homogenised tobacco material 8 as it is gathered by the converging funnel 10.

EXAMPLE 1

First rods for use in the invention comprising a gathered crimped sheet of homogenised tobacco material circumscribed by a paper wrapper were produced using apparatus of the type shown in FIG. 1. Continuous sheets of homogenised tobacco material comprising 12.5 percent by weight glycerine and 12.5 percent by weight triethyl citrate on a dry weight basis produced by a casting process were used to form the rods.

For the purpose of comparison, continuous sheets of homogenised tobacco material comprising 25 percent by weight glycerine on a dry weight basis were used to form second rods in an identical manner.

Heated aerosol-generating articles according to the invention comprising the first rods and heated aerosol-generating articles not according to the invention comprising the second rods were prepared. The sensory properties of the heated aerosol-generating articles were evaluated by a consumer panel.

Attributes including persistency, impact, harshness, tingling in the mouth and bitterness were rated higher by the panel for the heated aerosol-generating articles according to the invention comprising the first rods than for the heated aerosol-generating articles not according to the invention comprising the second rods. As a result, the global flavor perception of the heated aerosol-generating articles according to the invention comprising the first rods was evaluated as being more similar to the global flavor perception of conventional lit-end cigarettes than the heated aerosol-generating articles not according to the invention comprising the second rods.

EXAMPLE 2

Third rods for use in the invention comprising a gathered crimped sheet of homogenised tobacco material circumscribed by a paper wrapper were produced using apparatus of the type shown in FIG. 1. Continuous sheets of homogenised tobacco material comprising 9.4 percent by weight sorbitol, 3.1 percent by weight invert sugar and 7.5 percent by weight triethyl citrate on a dry weight basis produced by a casting process were used to form the rods.

The specific embodiments described above are intended to illustrate the invention. However, other embodiments may be made without departing from the spirit and scope of the invention as defined in the claims, and it is to be understood that the specific embodiments described above are not intended to be limiting.

The invention claimed is:

1. A heated aerosol-generating article, comprising:

an aerosol-generating substrate, wherein the aerosol-generating substrate comprises a rod comprising a gathered sheet of homogenised tobacco material circumscribed by a wrapper, wherein the gathered sheet of homogenised tobacco material extends along substantially an entire length of the rod and across substantially an entire cross-sectional area of the rod, and wherein the gathered sheet of homogenised tobacco material comprises at least about 5 percent by weight of a plasticiser on a dry weight basis and at least about 5 percent by weight triethyl citrate on a dry weight basis, wherein the plasticiser is glycerine, and wherein the sheet includes less than or equal to 25% by weight of the plasticiser and less than or equal to 25% by weight of the triethyl citrate.

2. The heated aerosol-generating article according to claim 1, wherein total amount of plasticiser and triethyl citrate in the gathered sheet of homogenised tobacco material is less than or equal to about 30 percent by weight on a dry weight basis.

3. The heated aerosol-generating article according to claim 1, wherein a ratio of percent by weight on a dry weight basis of plasticiser to triethyl citrate in the gathered sheet of homogenised tobacco material is between about 1:1 and about 2:1.

4. The heated aerosol-generating article according to claim 1, wherein the gathered sheet of homogenised tobacco material has a fracture force per unit width in a cross direction of at least about 160 N/m.

5. The heated aerosol-generating article according to claim 1, wherein the gathered sheet of homogenised tobacco material is crimped.

6. The heated aerosol-generating article according to claim 1, further comprising a combustible heat source.

7. A rod, comprising a gathered sheet of homogenised tobacco material circumscribed by a wrapper, wherein the gathered sheet of homogenised tobacco material extends along substantially an entire length of the rod and across substantially an entire cross-sectional area of the rod, and wherein the gathered sheet of homogenised tobacco material comprises a plasticiser that is glycerine and at least about 5 percent by weight triethyl citrate on a dry weight basis, configured as an aerosol-generating substrate in a heated aerosol-generating article.

* * * * *